US009199266B2

(12) United States Patent
Boukair et al.

(10) Patent No.: US 9,199,266 B2
(45) Date of Patent: Dec. 1, 2015

(54) PAINT ROLLER SHIELD

(71) Applicants: Moe Boukair, Redondo Beach, CA (US); Ronald Boukair, Skaneateles, NY (US)

(72) Inventors: Moe Boukair, Redondo Beach, CA (US); Ronald Boukair, Skaneateles, NY (US)

( * ) Notice: Subject to any disclaimer, the term of this patent is extended or adjusted under 35 U.S.C. 154(b) by 0 days.

(21) Appl. No.: 14/616,640

(22) Filed: Feb. 6, 2015

(65) Prior Publication Data

US 2015/0165473 A1 Jun. 18, 2015

Related U.S. Application Data

(60) Provisional application No. 62/020,183, filed on Jul. 2, 2014.

(51) Int. Cl.
*A46B 17/00* (2006.01)
*B05C 17/02* (2006.01)

(52) U.S. Cl.
CPC ..... *B05C 17/0222* (2013.01); *A46B 17/00* (2013.01); *B05C 17/0225* (2013.01)

(58) Field of Classification Search
CPC . A46B 17/00; B05C 17/0222; B05C 17/0225
See application file for complete search history.

(56) References Cited

U.S. PATENT DOCUMENTS

| | | | | | |
|---|---|---|---|---|---|
| 2,644,186 | A | * | 7/1953 | Guimond | 15/230.11 |
| 2,763,022 | A | * | 9/1956 | Glacken | 15/248.2 |
| 2,799,886 | A | * | 7/1957 | Brunelli et al. | 15/248.2 |
| 2,836,840 | A | * | 6/1958 | Pratt | 15/230.11 |
| 3,369,269 | A | * | 2/1968 | Deck et al. | 15/230.11 |
| 3,685,084 | A | * | 8/1972 | Bennett | 15/230.11 |
| 4,599,762 | A | * | 7/1986 | Rigter | 15/248.2 |
| 5,623,740 | A | * | 4/1997 | Burns et al. | 15/230.11 |
| 6,687,945 | B2 | * | 2/2004 | Robinson | 15/230.11 |
| 6,925,674 | B2 | * | 8/2005 | Prince et al. | 15/230.11 |

FOREIGN PATENT DOCUMENTS

| | | | |
|---|---|---|---|
| DE | 44 19 672 | * | 8/1995 |
| WO | WO 94/00245 | * | 1/1994 |

* cited by examiner

*Primary Examiner* — Randall Chin
(74) *Attorney, Agent, or Firm* — Michael D. Eisenberg

(57) ABSTRACT

A paint roller shield comprising a plate with a planar surface configured to have a beveled periphery with at least one flat edge along the periphery and a nonplanar surface configured to attach to a paint roller device.

9 Claims, 5 Drawing Sheets

PAINT ROLLER SHIELD

CROSS-REFERENCE TO RELATED APPLICATION

This application is a continuation of U.S. patent application No. 62/020,183, filed Jul. 2, 2014.

TECHNICAL FIELD

The present invention, in some embodiments thereof, relates to paint applicators, specifically rollers and shields, for precision in painting large scale projects.

BACKGROUND OF THE INVENTION

Painting rooms or walls often requires protecting areas that are not intended to be painted. Traditionally this has been done through slow but precise painting, using tarps to cover areas, and using painter's tape. All of these have problems such as increased time spent on projects, inadequate protection, and damages due to adhesive materials. Some devices utilize a method that creates a gap between the paint area and area that should remain unpainted, but this gap is of a size that either requires extreme care or the need to fill in the gap with a more precise means later. An improved paint applicator is needed that allows a user speed, adequate protection, and precision while painting, for example, walls near the ceiling.

BRIEF SUMMARY OF EMBODIMENTS OF THE INVENTION

The present invention relates to a shield for a paint roller that allows for quick and precise painting of one surface while keeping an adjacent surface free of paint.

One embodiment of the invention includes shield that may be attached to different types of existing paint rollers. Another embodiment of the invention has a handle attached to a frame, which attaches to a shield and roller. The handle allows for an easy grip and the frame includes a neck. The neck may have alternate configurations depending on the type of work such as for walls generally, or with a longer neck for high ceilings. In one configuration the neck forms an "s" shape with the handle extending away from the lower leg of the "s" and the shield extending off of the upper leg. The frame also includes a roller to which the roller cover is applied. The roller cover is the portion that applies paint to a wall. In one embodiment, the roller itself is connected to the frame and moves concentrically using the leg of the frame it is attached to as an axle. Alternatively there may be device that rotates concentrically about the leg of the frame that the roller cover attaches to. In this embodiment the roller has a ¾ inch outer diameter while the roller cover has an inner diameter of ¾ inch and a length of 4 inches. The frame and shield may be designed to accommodate a variety of roller covers.

The shield has a stem and a plate. The shield is designed for the planar plate portion to be flush against a surface, such as a ceiling. This surface, such as a ceiling, is generally perpendicular to the surface that is intended to be painted, such as the wall. The stem, which is optionally shaped cylindrically, allows the shield to attach to the frame. In one embodiment, this is achieved by the stem being hollow and having one base that is open. The second base is attached to the plate. In one embodiment, the plate is substantially planar, circular and with one edge flattened, as though it have been cut at a secant line through the circular plate. The diameter in this embodiment is 1½ inches, but other embodiments may have different sizes. The size of the shield is based on the diameter of the roller cover such that all of the edge of the roller cover will be blocked by the shield except for the flattened portion of the shield. However during painting, the flat edge may be flush with the ceiling and thus blocking any paint from the roller cover to travel past the shield. This plate has a width that allows the roller cover to come within a very close proximity of area that is not intended to be painted, such as a ceiling. In this embodiment it has a 1/64 inch thickness with a beveled ⅛ inch edge angled at 45 degrees away from the ceiling (or other surface not intended to be painted). There is no angled portion on the flat edge of the shield that has been cut as though through a secant line. The shield is designed such that the flat portion will press against wall that is intended to be painted and can be arranged at whatever angle the user desires. Once placed the shield will not rotate but will stay fixed with the frame as the roller and roller cover rotate about an axle formed by the frame.

Optionally, the shield is made from polypropylene #5, but may be made from other materials or plastics.

In another embodiment of the invention, the beveled edge may have different proportions of bevel angle and bevel length.

In another embodiment, the diameter of the shield can differ from the 1½ inch. This diameter is selected to utilize an appropriately reduced amount of materials necessary for a shield for a roller cover with an inner diameter of ¾ inches. The diameter of the shield, the location of the secant line forming the flattened portion of shield, and size of the roller cover may all differ from the current embodiment, though they must remain in relation to one another such that the diameter of the shield is greater than the outer diameter of the roller cover, but allowing the roller cover to extend past the flat portion. It is possible in other embodiments that the shield not be generally circular. Other shapes may be used. However there must be one flat edge that does not extend past the roller cover and allows the paint to be applied to the intended surface.

In another embodiment, the stem of the shield can be altered to configure to differently shaped termini of frames.

In another embodiment, the frame may be configured in a different formation such as straight or an "s" shape with a handle extending perpendicular to lower leg of the "s".

The present invention relates to a paint roller shield comprising a plate with a planar surface configured to have a beveled periphery with at least one flat edge along the periphery and a nonplanar surface configured to attach to a paint roller device.

The paint roller shield may have variations. The plate, in a variant, is substantially round with one flat edge configured to allow paint to be applied to one particular surface. The attachment to the paint roller device, in one variant, is a hollow cylindrical tube configured to fit over the end of a paint roller device and stay fixed in relation to a roller cover, which applies paint.

The beveled edge, in a variant, is angled between 5° and 85° and slopes outwardly away from the planar surface. In another variant of the beveled edge, it has a length of about ⅛ of an inch. In yet another variant of the beveled edge, the flat edge is not beveled. Further, in one variant, the flat edge of the plate is configured such that with a substantially circular plate edge is configured as a missing portion of the circle defined by a secant.

Variants of the shield may be configured with a diameter of at least 1.5 inches to accommodate a 4 inch roller cover with an inner diameter of 0.75 inches, but may also be configured with similar ratios depending on the size of the roller cover.

In one variant, the paint roller device and shield are designed as a matching set.

Other features and aspects of the invention will become apparent from the following detailed description, taken in conjunction with the accompanying drawings, which illustrate, by way of example, the features in accordance with embodiments of the invention. The summary is not intended to limit the scope of the invention, which is defined solely by the claims attached hereto.

BRIEF DESCRIPTION OF THE DRAWINGS

The present invention, in accordance with one or more various embodiments, is described in detail with reference to the following figures. The drawings are provided for purposes of illustration only and merely depict typical or example embodiments of the invention. These drawings are provided to facilitate the reader's understanding of the invention and shall not be considered limiting of the breadth, scope, or applicability of the invention. It should be noted that for clarity and ease of illustration these drawings are not necessarily made to scale.

Some of the figures included herein illustrate various embodiments of the invention from different viewing angles. Although the accompanying descriptive text may refer to such views as "top," "bottom" or "side" views, such references are merely descriptive and do not imply or require that the invention be implemented or used in a particular spatial orientation unless explicitly stated otherwise.

The present invention, in accordance with one or more various embodiments, is described in detail with reference to the following figures. The drawings are provided for purposes of illustration only and merely depict typical or example embodiments of the invention. These drawings are provided to facilitate the reader's understanding of the invention and shall not be considered limiting of the breadth, scope, or applicability of the invention. It should be noted that for clarity and ease of illustration these drawings are not necessarily made to scale.

Some of the figures included herein illustrate various embodiments of the invention from different viewing angles. Although the accompanying descriptive text may refer to such views as "top," "bottom" or "side" views, such references are merely descriptive and do not imply or require that the invention be implemented or used in a particular spatial orientation unless explicitly stated otherwise.

Figure 1:
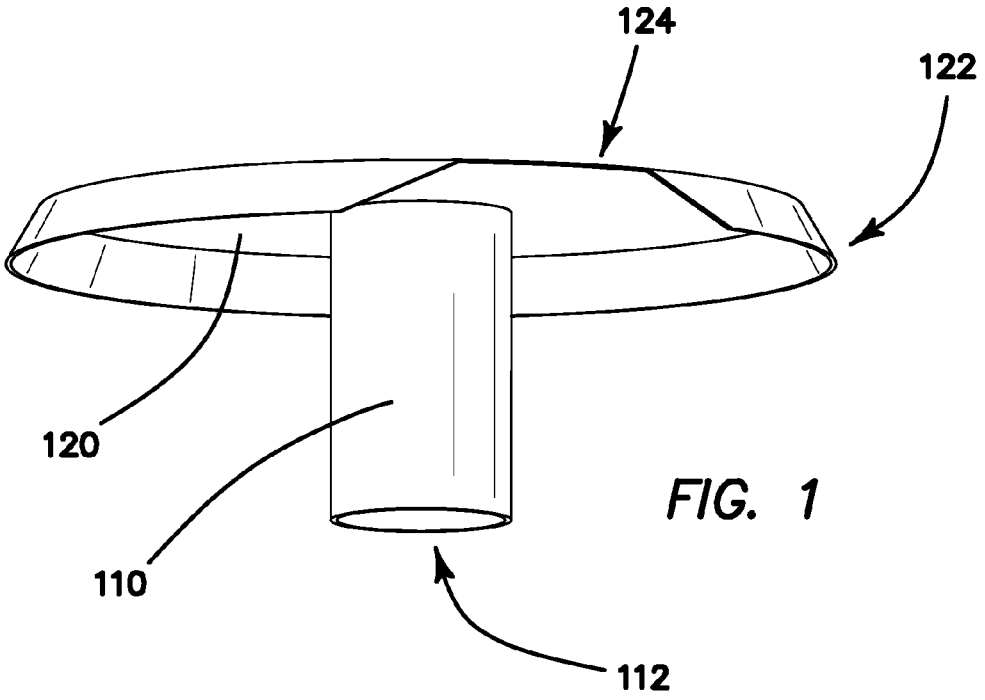
Figure 2:
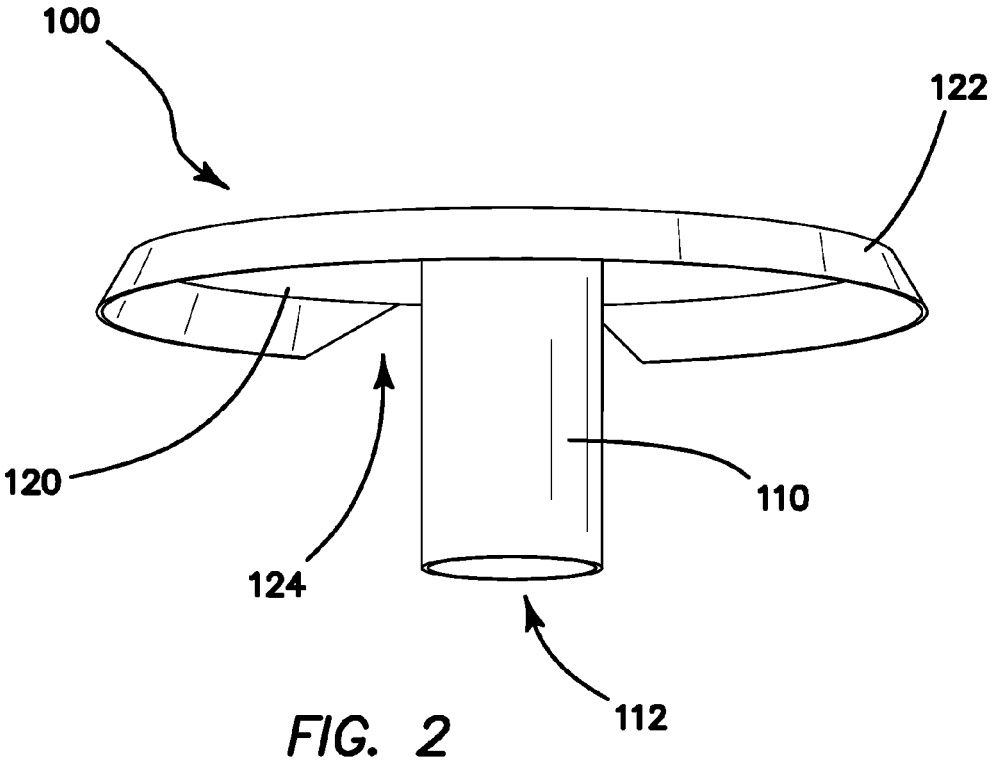

FIGS. 1 and 2 illustrate two different perspective views of the shield.

Figure 3:
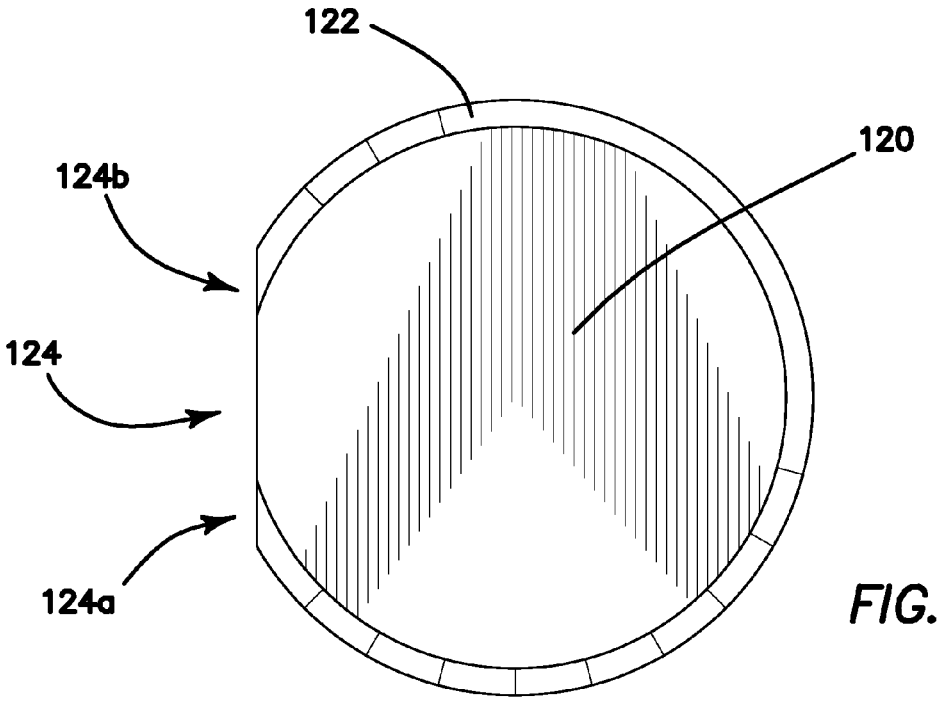

FIG. 3 illustrates a top view of the shield.

Figure 4:
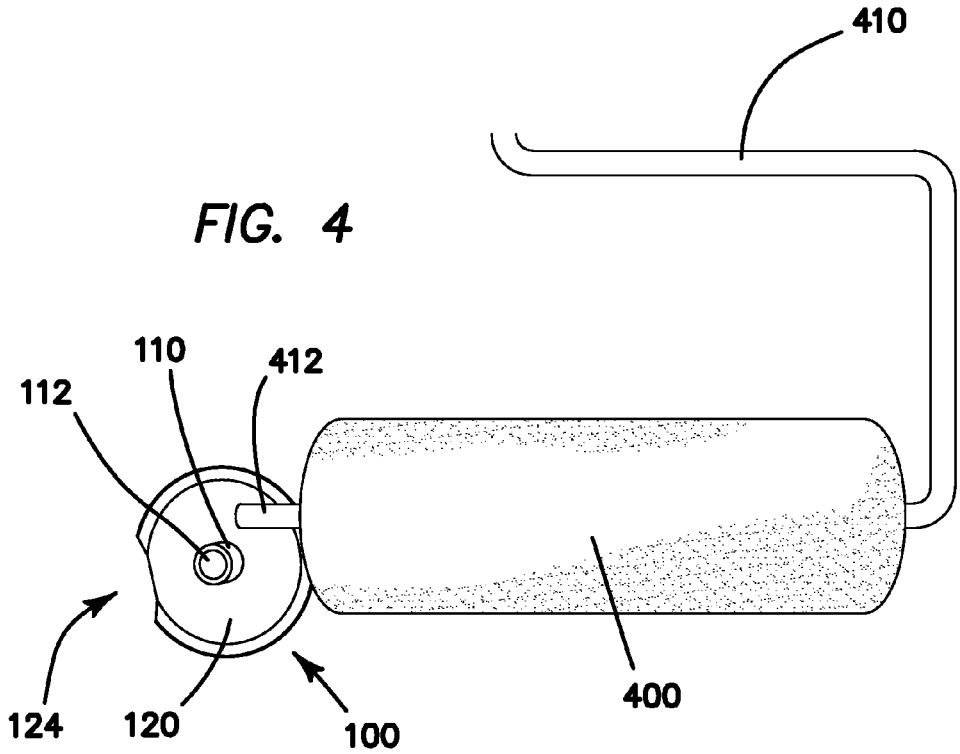

FIG. 4 illustrates the shield, frame, and roller cover with the shield separated.

Figure 5:
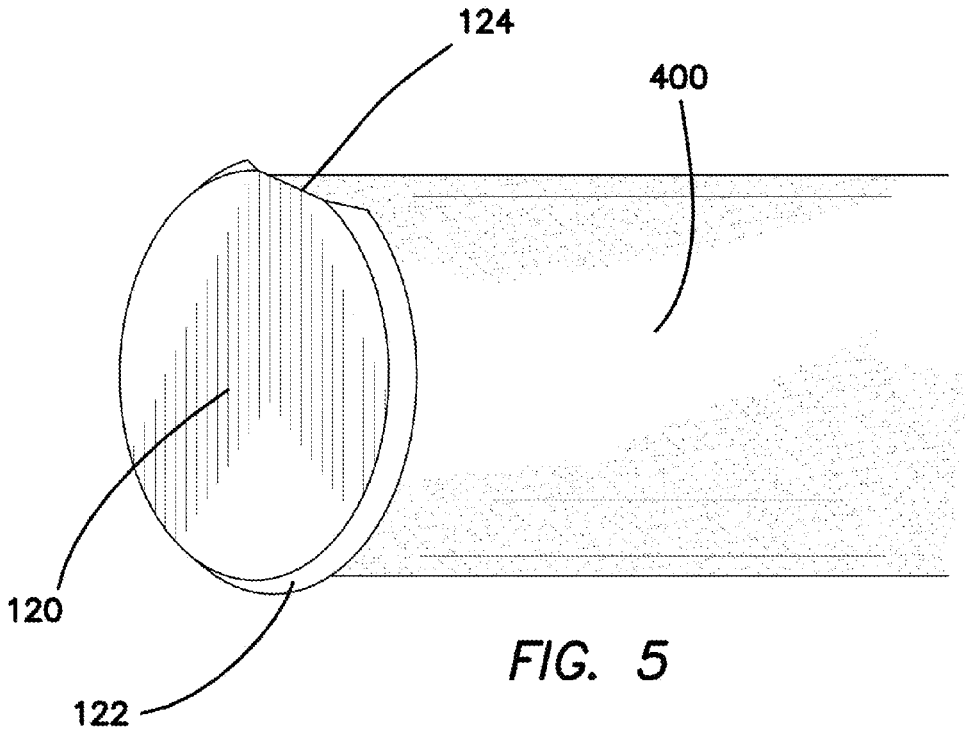

FIG. 5 illustrates the shield, frame, and roller cover together.

Figure 6:
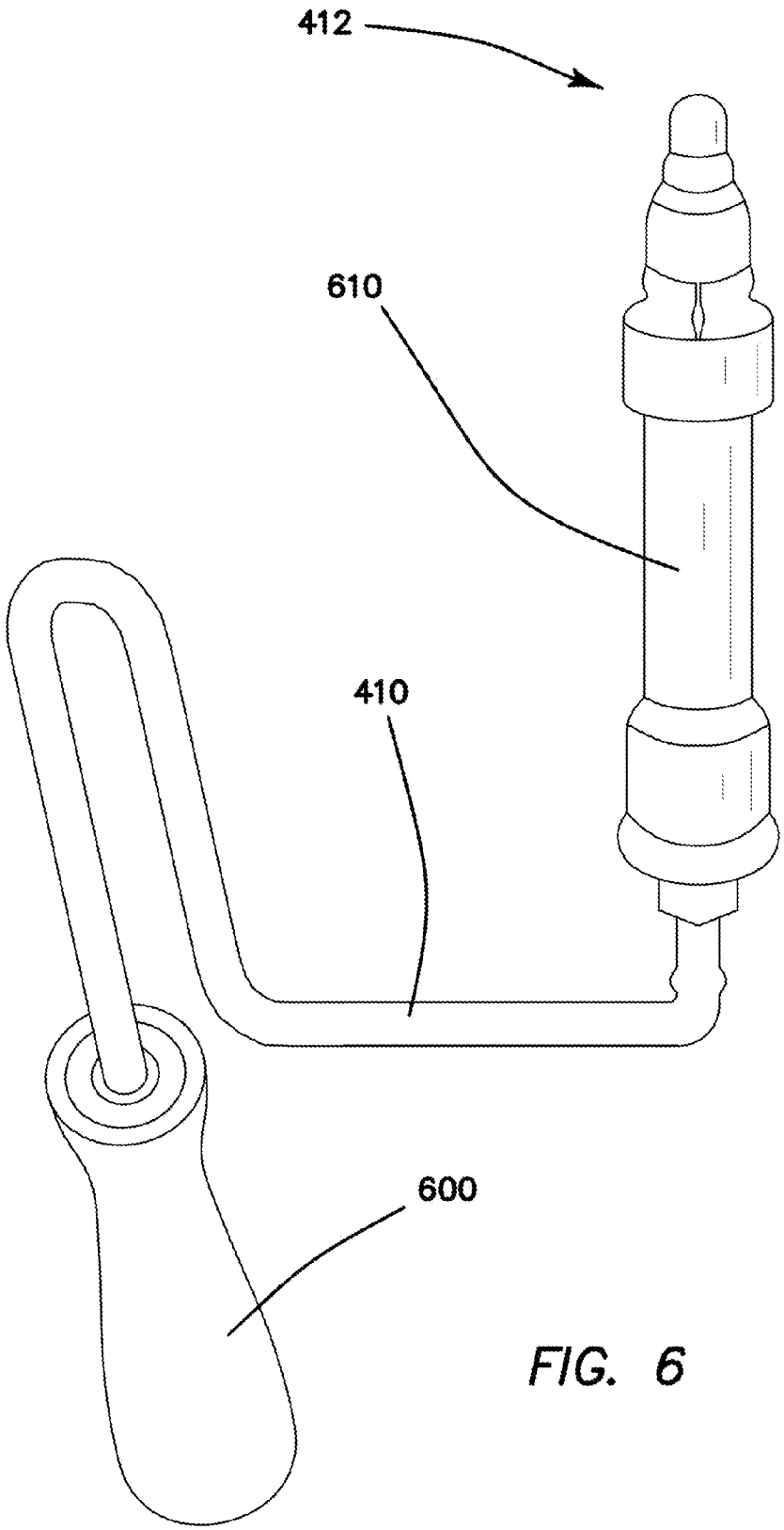

FIG. 6 illustrates the frame, roller, and handle.

Figure 7:
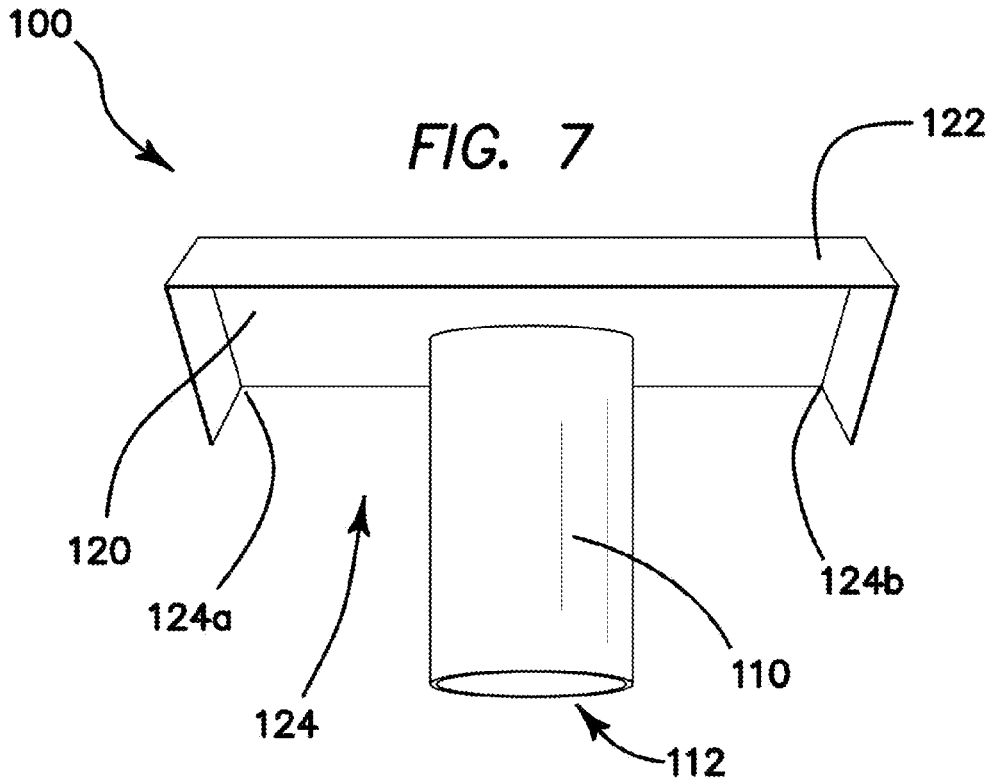

FIG. 7 illustrates an alternate configuration for the shield.

The figures are not intended to be exhaustive or to limit the invention to the precise form disclosed. It should be understood that the invention can be practiced with modification and alteration, and that the invention be limited only by the claims and the equivalents thereof.

DETAILED DESCRIPTION OF THE EMBODIMENTS OF THE INVENTION

From time-to-time, the present invention is described herein in terms of example environments. Description in terms of these environments is provided to allow the various features and embodiments of the invention to be portrayed in the context of an exemplary application. After reading this description, it will become apparent to one of ordinary skill in the art how the invention can be implemented in different and alternative environments.

Unless defined otherwise, all technical and scientific terms used herein have the same meaning as is commonly understood by one of ordinary skill in the art to which this invention belongs. All patents, applications, published applications and other publications referred to herein are incorporated by reference in their entirety. If a definition set forth in this section is contrary to or otherwise inconsistent with a definition set forth in applications, published applications and other publications that are herein incorporated by reference, the definition set forth in this document prevails over the definition that is incorporated herein by reference.

The following reference numbers are used in this document:

100 shield
110 stem
112 hollow interior
120 plate
122 beveled edge
124 flat portion
124*a* and 124*b* to points forming a secant line
400 roller cover
410 frame
412 frame terminus
600 handle
610 roller The present invention relates to a paint roller assembly that includes a shield 100. In one embodiment, FIGS. 1 and 2 show two different perspective views of the shield 100. The shield 100 has a stem 110 and a plate 120. The stem 110 is generally cylindrical and has a hollow interior 112 leading to the exterior on one side. The stem 110 is connected to the middle of the plate 120 at the other side. The plate 120 is generally flat and round and the plate 120 has a beveled edge 122 extending downwards from the plate. In one embodiment, the beveled edge 122 is at a 45 degree angle. Other embodiments can have beveled edges 122 that range from 5 to 85 degrees. In the present embodiment, the beveled edge 122 is at a length of ⅛ of an inch. The plate 120 and beveled edge 122 have a flat portion 124 cut out from the plate 120.

Referring to FIG. 3, a top view of the shield 120 is provided. The flat portion 124 is formed as though a section were cut off of a circle by a secant line connecting 124*a* and 124*b*. This means that the flat portion 124 itself has no beveled edge 122 but can rest flush against a wall while the plate 120 rests against a perpendicular ceiling.

Referring to FIG. 4, the shield 100 is illustrated with a roller frame 410 and roller cover 400. The hollow interior 112 is visible in this view and can be attached at this point to the frame terminus 412. The shield 100 does not rotate about this terminus 412. In this embodiment it remains removably attached as can be seen in FIG. 5. In another embodiment the shield 100 may remain permanently attached to the terminus 412. FIG. 5 further shows that the diameter of the shield 100, which is 1½ inches in this embodiment, is configured to extend past the edge of a roller cover 400. An exception is the flat portion 124, which is designed to have roller cover 400 extend past it by cutting the secant line from 124*a* to 124*b*.

FIG. 6 shows the frame 410, roller 610, and handle 600. This is the structure that a roller cover 400 and shield 100 are attached to. The roller 610 is where the roller cover 400 is placed. In this embodiment the roller 610 has a ¾ inch outer diameter while the roller cover 400 has an inner diameter of ¾ inch and a length of 4 inches.

FIG. 7 shows an alternate configuration for the shield 100. In this particular alternate configuration the shield 100 is of a square design containing a beveled edge 122 along three of the edges and leaving a flat portion 124 with no beveled edge 122. The distance from 124*a* to 124*b* is at least as long as the outer diameter of the roller cover 400.

In another embodiment the roller and roller cover may differ from the 4 inch length. The most commonly used lengths would be between 4 to 6 inches.

(1) In a variant of the paint roller shield, a plate with a planar surface has a beveled periphery with at least one flat edge along the periphery and a nonplanar surface configured to attach to a paint roller device.

(2) In another variant, the plate is substantially round with one flat edge configured to shield at least one particular surface from paint, while painting another surface.

(3) In a further variant, the beveled edge is angled between 5° and 85° and slopes outwardly away from the planar surface.

(4) In still another variant, the paint roller shield comprises a hollow cylindrical tube configured to fit over the end of a paint roller device and remain rotatably fixed in relation to a rotating roller cover, which applies paint.

(5) In yet a further variant, the paint roller shield has a beveled periphery at a length of about ⅛ of an inch.

(6) In a variant of the paint roller shield, the flat edge is unbeveled (not beveled).

(7) In another variant, the paint roller shield has a flat edge of the plate configured such that with a substantially circular plate edge is configured as a missing portion of the circle defined by a secant.

(8) In a further variant, the shield is configured with a diameter of at least 1.5 inches to accommodate a 4 inch roller cover with an inner diameter of 0.75 inches.

(9) In a yet another variant, the paint roller shield is connected to a paint roller device, wherein the shield is scaled in size to match the size of the roller cover of the paint roller device to which it is attached.

(10) In a variant, the paint roller device and shield are designed as a matching set.

(11) In another variant, a paint roller shield comprises a plate with a planar surface having a substantially round and beveled periphery with at least one flat edge along the periphery and a nonplanar surface configured to attach to a paint roller device. The beveled edge is angled between 5° and 85° and slopes outwardly away from the planar surface. A hollow cylindrical tube configured to fit over the end of a paint roller device and remain rotatably fixed in relation to a rotating roller cover, which applies paint. A plan view of the plate, the flat edge comprises the edge of a cutout from a circle at a secant line. The shield protects at least one particular surface from paint, while the paint roller device paints another surface.

While various embodiments of the present invention have been described above, it should be understood that they have been presented by way of example only, and not of limitation. Likewise, the various diagrams may depict an example architectural or other configuration for the invention, which is done to aid in understanding the features and functionality that can be included in the invention. The invention is not restricted to the illustrated example architectures or configurations, but the desired features can be implemented using a variety of alternative architectures and configurations. Indeed, it will be apparent to one of skill in the art how alternative functional, logical or physical partitioning and configurations can be implemented to implement the desired features of the present invention. Also, a multitude of different constituent module names other than those depicted herein can be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the invention is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the invention, whether or not such embodiments are described and whether or not such features are presented as being a part of a described embodiment. Thus the breadth and scope of the present invention should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

A group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the invention may be described or claimed in the singular, the plural is contemplated to be within the scope thereof unless limitation to the singular is explicitly stated.

The presence of broadening words and phrases such as "one or more," "at least," "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, can be combined in a single package or separately maintained and can further be distributed across multiple locations.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

What is claimed is:

1. A paint roller and paint roller shield assembly, comprising:

a roller for applying paint, having a paint applying surface that terminates at a rim located at an end of the roller;

a paint roller shield, connected to the end of the roller, comprising:

a plate with a planar surface having a substantially round and beveled peripheral edge and a flat portion cutout defined by a secant configured as a missing portion of the plate;

wherein the beveled peripheral edge is angled between 5° and 85° and slopes outwardly away from the planar surface;

a hollow cylindrical tube configured to fit over the end of the roller and remains rotatably fixed in relation to the roller when the roller rotates;

wherein in a plan view of the plate, the cutout exposes a part of the rim comprising part of the paint applying surface of the roller and wherein the plate and the beveled peripheral edge covers a remaining part of the rim of the roller not exposed by the cutout.

2. The paint roller and paint roller shield assembly of claim 1, wherein the beveled peripheral edge is at a length of about ⅛ of an inch.

3. The paint roller and paint roller shield assembly of claim 1, wherein the flat portion cutout is unbeveled.

4. The paint roller and paint roller shield assembly of claim 1, wherein the shield is configured with a diameter of at least 1.5 inches to accommodate a 4 inch roller with an inner diameter of 0.75 inches.

5. A paint roller and paint roller shield assembly, comprising:

a roller for applying paint, having a paint applying surface that terminates at a rim located at an end of the roller;

a paint roller shield, connected to the end of the roller, comprising:

a plate with a planar surface having a substantially round and beveled peripheral edge and a flat portion cutout defined by a secant configured as a missing portion of the plate;

a hollow cylindrical tube configured to fit over the end of the roller and remains rotatably fixed in relation to the roller when the roller rotates, which applies paint;

wherein in a plan view of the plate, the cutout exposes a part of the rim comprising part of the paint applying surface of the roller and wherein the plate and the beveled peripheral edge covers a remaining part of the rim of the roller not exposed by the cutout.

6. The paint roller and paint roller shield assembly of claim 5, wherein the beveled peripheral edge is at a length of about ⅛ of an inch.

7. The paint roller and paint roller shield assembly of claim 5, wherein the flat portion cutout is unbeveled.

8. The paint roller and paint roller shield assembly of claim 5, wherein the shield is configured with a diameter of at least 1.5 inches to accommodate a 4 inch roller with an inner diameter of 0.75 inches.

9. The paint roller and paint roller shield assembly of claim 5, wherein the beveled peripheral edge is angled between 5° and 85° and slopes outwardly away from the planar surface.

* * * * *